US011372435B2

(12) United States Patent
Torrisi et al.

(10) Patent No.: US 11,372,435 B2
(45) Date of Patent: Jun. 28, 2022

(54) DUAL LDO VOLTAGE REGULATOR DEVICE WITH INDEPENDENT OUTPUT VOLTAGE SELECTION

(71) Applicant: STMicroelectronics S.r.l., Agrate Brianza (IT)

(72) Inventors: Giovanni Luca Torrisi, Aci Catena (IT); Salvatore Abbisso, Augusta (IT); Cristiano Meroni, Milan (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 115 days.

(21) Appl. No.: 16/804,994

(22) Filed: Feb. 28, 2020

(65) Prior Publication Data

US 2020/0285259 A1 Sep. 10, 2020

(51) Int. Cl.
*G05F 1/565* (2006.01)
*G05F 1/575* (2006.01)

(52) U.S. Cl.
CPC ..... *G05F 1/565* (2013.01); *G05F 1/575* (2013.01)

(58) Field of Classification Search
CPC ..... G05F 1/565; G05F 1/571; G05F 1/575; G05F 1/577; G05F 1/59; H02J 1/10; H02J 1/106; H02J 1/122
USPC ..... 323/269–289, 315
See application file for complete search history.

(56) References Cited

U.S. PATENT DOCUMENTS 6,201,375 B1 * 3/2001 Larson ..... G05F 1/573 323/277
6,894,470 B2 * 5/2005 Umemoto ..... G05F 1/46 323/281
7,274,114 B1 9/2007 Wong
(Continued)

FOREIGN PATENT DOCUMENTS

CN 202009418 U 10/2011
CN 108427462 A 8/2018
(Continued)

OTHER PUBLICATIONS

IT Search Report and Written Opinion for IT Appl. 102019000003331 dated Nov. 27, 2019 (9 pages).
(Continued)

*Primary Examiner* — Thienvu V Tran
*Assistant Examiner* — Nusrat Quddus
(74) *Attorney, Agent, or Firm* — Crowe & Dunlevy

(57) ABSTRACT

A voltage regulator circuit includes a first voltage regulator having a first output voltage selection pin set and producing a first output voltage based on a first digital signal received at the first output voltage selection pin set, and a second voltage regulator having a second output voltage selection pin set and producing a second output voltage based on a second digital signal received at the second output voltage selection pin set. The first and second voltage regulators are operable in a voltage tracking mode with the output voltage of the second voltage regulator tracking the output voltage of the first voltage regulator when digital signals received at the selection pin sets have a same value. An overvoltage sensor detects overvoltage events at the first voltage regulator. Control circuitry selectively avoids operation in voltage tracking mode as a result of an overvoltage event detected at the first voltage regulator.

17 Claims, 4 Drawing Sheets

(56) References Cited

U.S. PATENT DOCUMENTS

| | | | | |
|---|---|---|---|---|
| 7,276,885 | B1 * | 10/2007 | Tagare | G05F 1/577 323/267 |
| 7,336,058 | B1 * | 2/2008 | Lo | G05F 1/575 323/269 |
| 7,723,969 | B1 * | 5/2010 | Li | G05F 1/565 323/276 |
| 2002/0135339 | A1 * | 9/2002 | Tang | G06F 1/26 323/274 |
| 2004/0070276 | A1 * | 4/2004 | Liu | G05F 1/575 307/39 |
| 2008/0278124 | A1 | 11/2008 | Aiura et al. | |
| 2014/0223205 | A1 * | 8/2014 | Muthukaruppan | G06F 1/324 713/320 |
| 2018/0188753 | A1 * | 7/2018 | Derman | G05F 1/575 |
| 2018/0198416 | A1 * | 7/2018 | Hur | H03F 3/193 |
| 2019/0372460 | A1 * | 12/2019 | Cuenca | G05F 1/56 |

FOREIGN PATENT DOCUMENTS

| | | | |
|---|---|---|---|
| CN | 109298744 | A | 2/2019 |
| EP | 3015943 | A1 | 5/2016 |

OTHER PUBLICATIONS

First Office Action and Search Report for co-pending CN Appl. No. 202010151991.9 dated Jul. 9, 2021 (6 pages).

* cited by examiner

DUAL LDO VOLTAGE REGULATOR DEVICE WITH INDEPENDENT OUTPUT VOLTAGE SELECTION

PRIORITY CLAIM

This application claims the priority benefit of Italian Application for Patent No. 102019000003331, filed on Mar. 7, 2019, the content of which is hereby incorporated by reference in its entirety to the maximum extent allowable by law.

TECHNICAL FIELD

The description relates to power management circuits such as voltage regulators. Low dropout (LDO) linear voltage regulators are exemplary of circuits to which embodiments described herein may apply.

BACKGROUND

Low dropout regulators (LDOs) provide a simple, inexpensive way of regulating an output voltage derived from a higher voltage input. The designation "dropout voltage" applies to the lowest (minimum) voltage across the regulator for which regulation can be maintained satisfactorily. For instance, an input voltage of (at least) 5.5 V applied to a 5 V regulator corresponds to a dropout voltage of 0.5 V.

An area of increasingly extended use of such voltage regulators is the automotive field. For instance, off-board sensors and small current off-board modules for automotive applications may benefit from systems where both protection and output accuracy is provided for power supplies in arrangements where the power is delivered through a long cable from a main board.

Also, the ability to keep a low voltage tracking tolerance between a power supply for off-board sensors (auxiliary supply) and a main power supply (for supplying microcontroller units—MCUs and/or analog-to-digital converters—ADCs, for instance) facilitates integrity of voltage signals and thus represents a desirable feature. Low tolerances in tracking systems (that is, systems where an auxiliary supply "tracks" the voltage from a main power supply) facilitate robust driving operation.

A conventional approach in addressing these issues may involve a single voltage tracker LDO or a dual arrangement where an auxiliary voltage regulator "tracks" a main voltage regulator. Practical implementations of that approach may involve an external integrated circuit (IC) to track the primary regulated voltage, which may have a negative impact in terms of cost and space.

Despite the extensive activity in this area, further improved solutions are desirable.

SUMMARY

One or more embodiments may provide a dual LDO voltage regulator with independent output voltage selection and the capability of providing voltage tracking selectively.

In one or more embodiments, tracking mode operation may start when the input values for the desired output voltages are the same for a main and an auxiliary voltage regulator. That is, in one or more embodiments, two regulated outputs can be configured to be different and in that case voltage tracking operation is avoided.

If an overvoltage event is detected on the main regulated voltage, tracking mode operation is avoided (that is, not enabled or discontinued) with the second (auxiliary) voltage regulator operated independently of the main voltage regulator. Not enabling tracking mode operation may be helpful, for instance, in the case of a power up operation accompanied by an output overvoltage. Discontinuing tracking mode operation may be helpful, for instance, in the case of an output overvoltage with two LDOs configured to provide a same output voltage.

In both cases a negative impact on the auxiliary voltage regulator can thus be avoided by via such a "de-tracking" action.

BRIEF DESCRIPTION OF THE DRAWINGS

One or more embodiments will now be described, by way of example only, with reference to the annexed figures wherein.

DETAILED DESCRIPTION

In the ensuing description, one or more specific details are illustrated, aimed at providing an in-depth understanding of examples of embodiments of this description. The embodiments may be obtained without one or more of the specific details, or with other methods, components, materials, etc. In other cases, known structures, materials, or operations are not illustrated or described in detail so that certain aspects of embodiments will not be obscured.

Reference to "an embodiment" or "one embodiment" in the framework of the present description is intended to indicate that a particular configuration, structure, or characteristic described in relation to the embodiment is comprised in at least one embodiment. Hence, phrases such as "in an embodiment" or "in one embodiment" that may be present in one or more points of the present description do not necessarily refer to one and the same embodiment. Moreover, particular conformations, structures, or characteristics may be combined in any adequate way in one or more embodiments.

The references used herein are provided merely for convenience and hence do not define the extent of protection or the scope of the embodiments.

Figure 1:
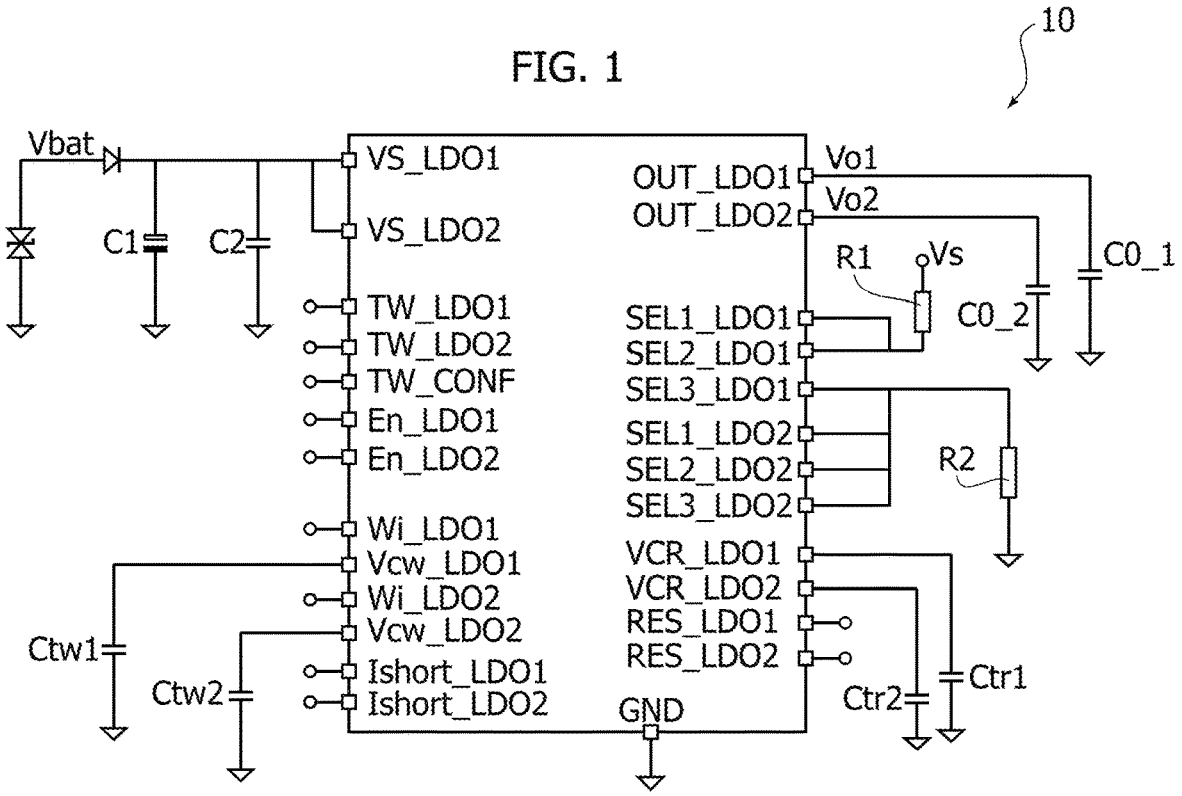
FIG. 1 is a block diagram of a voltage regulator in accordance with this disclosure.

FIG. 1 is a block diagram of an exemplary low dropout (LDO) voltage regulator 10 configured to be coupled to a voltage supply source Vbat—from the battery of a motor vehicle, for instance—to derive therefrom two regulated output voltages Vo1 and Vo2.

As shown by way of example in FIG. 1, the voltages Vo1, Vo2 may be provided at two respective output nodes OUT_LDO1 and OUT_LDO2 of the circuit 10. As shown by way of example in FIG. 1, the voltages Vo1, Vo2 may be provided across two respective output capacitances C0_1 and C0_2.

As shown by way of example in FIG. 1, the voltages Vo1, Vo2 may have respective (identical or different) values as a function of selection values applied to a first set of output voltage selection pins SEL1_LDO1, SEL2_LDO1, SEL_LDO1 (hereinafter, briefly, SELx_LDO1, with x=1, 2, or 3) and a second set of output voltage selection pins SEL1_LDO2, SEL2_LDO2 and SEL3_LDO2, (hereinafter, briefly, SELx_LDO2, with x=1, 2, or 3) respectively.

As shown by way of example in FIG. 1, the selection values applied to the selection pins SELx_LDO1 and SELx_LDO2 may be regarded as corresponding to binary values. As shown by way of example in FIG. 1, each set of output voltage selection pins SELx_LDO1 and SELx_LDO2 includes three selection pins to which binary values ranging from "000" to "111" may be applied, corresponding to $2^3=8$ different values for the output voltages Vo1 (at output pin OUT_LDO1) and Vo2 (at output pin OUT_LDO2).

This may occur, for instance, according to an exemplary table reproduced below.

| Vo1/ Vo2 | SEL1_LDO1/ SEL1_LDO2 | SEL2_LDO1/ SEL2_LDO2 | SEL3_LDO1/ SEL3_LDO2 |
|---|---|---|---|
| 5 | 1 | 1 | 1 |
| 3.3 | 1 | 1 | 0 |
| 2.8 | 1 | 0 | 1 |
| 2.5 | 1 | 0 | 0 |
| 1.8 | 0 | 1 | 1 |
| 1.5 | 0 | 1 | 0 |
| 1.2 | 0 | 0 | 1 |
| 0.8 | 0 | 0 | 0 |

In the table reproduced above, SELx_LDO1 and SELx_LDO2 (with x=1, 2, or 3) indicate possible binary values ("0" or "1") applied to the pins SEL1_LDO1, SEL2_LDO1, SEL3_LDO1 and SEL1_LDO2, SEL2_LDO2 and SEL3_LDO2.

It will be appreciated that in one or more embodiments the number of output voltage selection pins SELx (x=1, 2, . . . , n) may be different from the number three (n=3) exemplified herein. In general, $2^n$ different values can be provided for the output voltages at the output pins OUT_LDO1, OUT_LDO2 with the value of the output voltage at each voltage regulator output OUT_LDO1, OUT_LDO2, . . . being selectable via a combination of the binary values applied to a respective set of selection pins SELx.

Such binary values can be applied to the selection pins SELx, for instance by coupling resistors such as R1, R2 to "pull" the selection pins to a voltage selected between a reference voltage Vs (logic "1") and ground voltage (logic "0").

Also, while two output voltages Vo1, Vo2 and two output pins OUT_LDO1 and OUT_LDO2 are exemplified for the sake of simplicity, a multi-output voltage regulator 10 as exemplified herein may in fact provide regulated output voltages in excess of two.

The exemplary representation of FIG. 1 exemplifies—merely by way of completeness and without any intent of limitation of the embodiments—various (non-mandatory) pin functionalities in the case of two embedded temperature sensors generating two clusters, one for each LDO. Also various other pins may be included in a multi-output voltage regulator 10 as exemplified.

These pins exemplified in FIG. 1 may include, for instance:

- VS_LDOx (x=1, 2): input pins intended to be coupled to the supply source Vbat, for instance, with the provision of a rectifier/stabilizer network including a diode and capacitors C1, C2, as exemplified herein; it will be otherwise appreciated that the supply source Vbat and the rectifier/stabilizer network may be distinct elements from the embodiments;
- TW_LDOx (x=1, 2): output pins configured to be connected to a microcontroller (not visible) indicating either a thermal warning on a clustered LDO or an output OV event;
- TW_CONF: input pin configuring TW_LDOx (x=1, 2) in an AND (each clustered LDO is managed independently) or an OR (two clustered LDOs are managed by only one output TW (TW_LDO1)) combination;
- EN_LDOx (x=1, 2): enable pins, one for each LDO;
- Wi_LDOx (x=1, 2): watchdog input, one for each LDO, where Ctw1 and Ctw2 are capacitors coupled to respective pins Wcw LDOx (x=1, 2) to set the watchdog open window for each LDO);
- Ishort_LDOx (x=1, 2): input pins dedicated to modulate the short current limit for each LDO;
- VCR_LDOx (x=1, 2): input pins connected to external capacitor setting (via respective capacitors Ctr1 and Ctr2) the delay time (tr) for a reset signal for each LDO;
- RES_LDOx (x=1, 2): RESET output pins connected to microcontrollers one for each LDO.

A dual voltage regulator 10 as exemplified herein (taken as exemplary of a multi-output voltage regulator) may thus be regarded—at least notionally—as including at least one first voltage regulator LDO1 and at least one second voltage regulator LDO2.

Figure 2A:
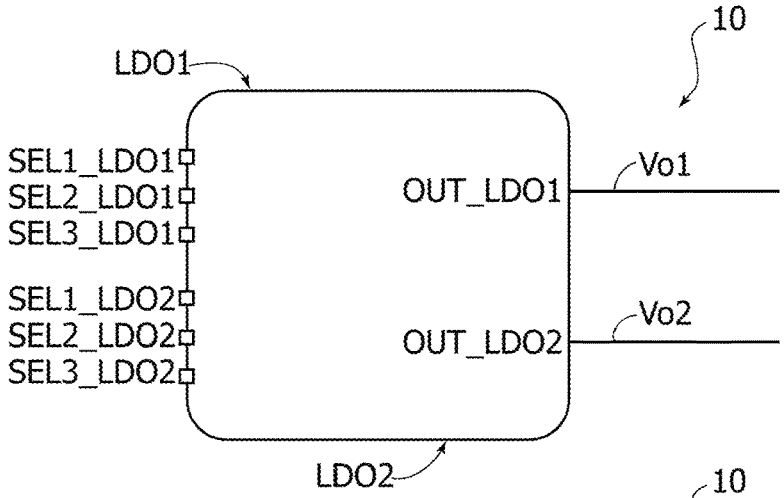
FIGS. 2A and 2B are exemplary of two possible modes of operation of a voltage regulator according to embodiments disclosed herein.
Figure 2B:
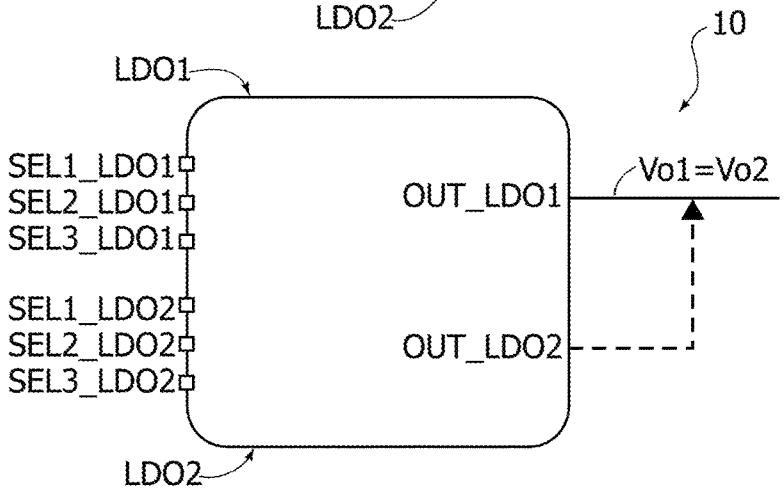

In one or more embodiments, in providing their output voltages Vo1, Vo2 at the outputs OUT_LDO1 and OUT_LDO2 as a function of the (binary) values applied to the output voltage selection pins SELx_LDO1 and SELx_LDO2, these regulators LDO1 and LDO2 may operate in at least two different modes as schematically represented in FIGS. 2A and 2B, respectively.

One or more embodiments are primarily related to the possibility of facilitating operation of a multi-output voltage regulator 10 in (at least) two different modes, namely:

- a first mode of operation, as exemplified in FIG. 2A, where the voltage regulators LDO1 and LDO2 operate as independent voltage regulators: this may result (but not necessarily so, as discussed in the following) from the digital values applied to the SELx pins being different for the two outputs OUT_LDO1, OUT_LDO2; and
- a second mode of operation, as exemplified in FIG. 2B, where the voltage regulator LDO2 "tracks" the voltage regulator LDO1: this may result from the digital values applied to the SELx pins being equal for the two outputs OUT_LDO1, OUT_LDO2.

For instance, by referring to the table reproduced in the foregoing, assuming that the same digital value or configuration (for instance "111") is applied to both sets of selection pins SELx_LDO1 and SELx_LDO2, in the tracking mode of operation the output voltage Vo2 from LDO2 will "track" the 5 V voltage Vo1 from LDO1.

Figure 3:
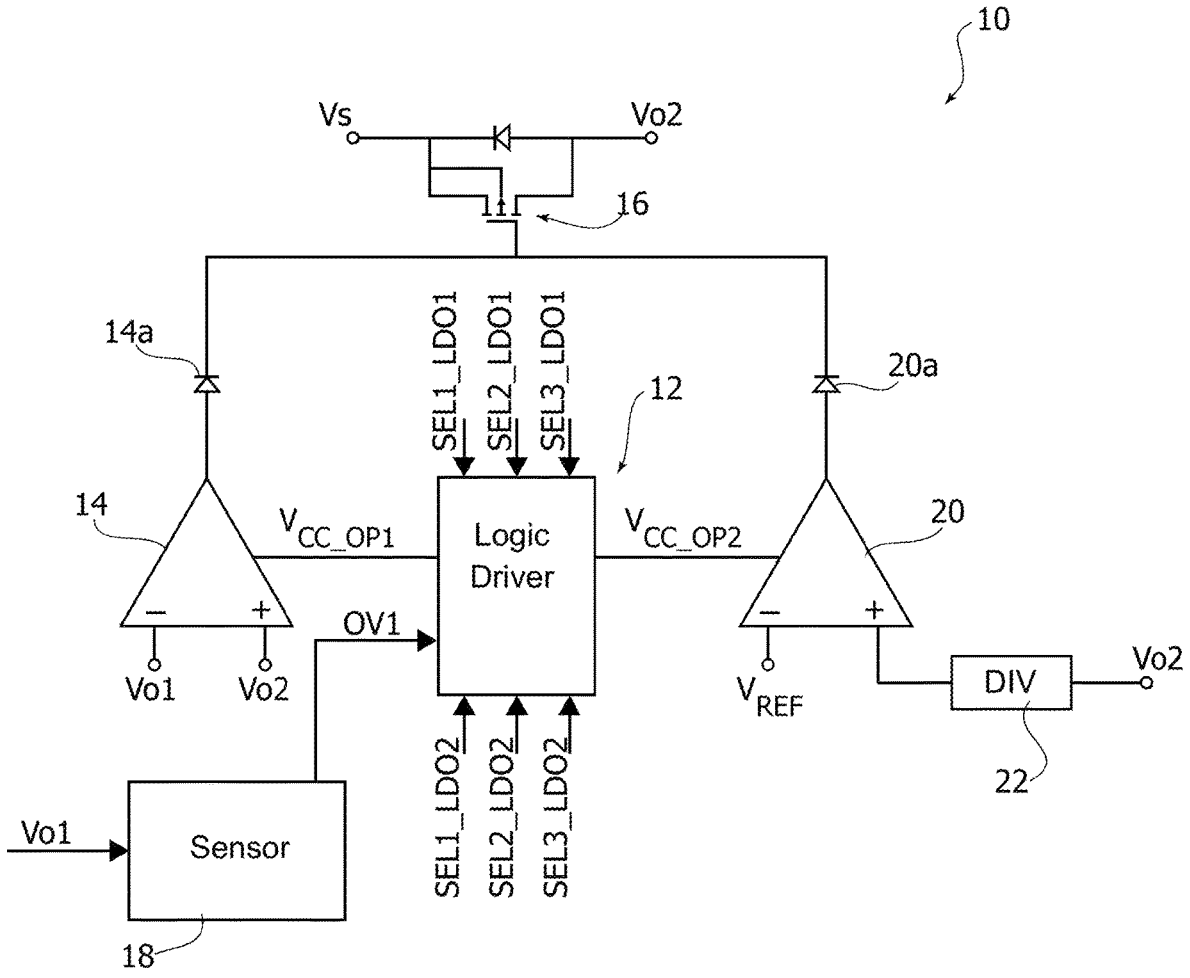
FIGS. 3, 4 and 5 are block diagrams exemplary of possible implementations of embodiments disclosed herein.

The block diagram of FIG. 3 is exemplary of a portion of a voltage regulator 10 as exemplified in FIG. 1 which facilitates implementing dual-mode operation as exemplified in FIGS. 2A and 2B.

In the block diagram of FIG. 3, reference 12 denotes a logic driver circuit sensitive to the binary configuration applied to the output voltage selection pins SELx_LDO1 and SELx_LDO2, namely SEL1_LDO1, SEL2_LDO1, SEL3_LDO1 and SEL1_LDO2, SEL2_LDO2, SEL3_LDO2 with the capability of detecting whether the binary configurations applied to these two sets of output voltage selection pins are different (with Vo2 expected to be different from Vo1) or identical (with Vo2 expected to be the same as Vo1).

The logic driver 12 can be configured (as further discussed in the following) to identify a condition of identity of the binary configurations applied to the two sets of output voltage selection pins SELx_LDO1 and SELx_LDO2 and to activate a differential stage such as an operation amplifier (briefly OpAmp) 14 via an activation signal $V_{CC_OP1}$.

The differential stage 14 receives at its inverting/non-inverting inputs the voltages Vo1, Vo2 expected to be provided at the output pins OUT_LDO1, OUT_LDO2 which can be generated (in any manner known to those of skill in the art) to be equal insofar that—in the case considered—the binary voltage selection values applied to the two sets of output voltage selection pins SELx_LDO1 and SELx_LDO2 are assumed to be identical. The output from the differential stage 14 can thus act (via a separation diode 14*a*, for instance) on an output switch 16 (a power MOSFET transistor, for instance) so that the voltage Vo2 provided at the output pin OUT_LDO2 merely "tracks" the (identical) voltage Vo1 provided at the output pin OUT_LDO1.

Such a "tracking" mode of operation corresponds to the mode of operation which is adopted in the voltage regulator in the condition exemplified in FIG. 2B.

Tracking mode operation facilitates uniformity of signal levels (within an electronic control unit, for instance, by avoiding possible misinterpretation of information acquired by a microcontroller, for instance). As discussed herein, tracking mode operation may be adopted when the LDOs involved are configured to provide a same output voltage level.

Tracking mode operation may be exposed to the risk that an overvoltage event affecting the voltage Vo1 at the output pin OUT_LDO1 may correspondingly affect the (identical) voltage Vo2 resulting from the tracking action and provided at the output pin OUT_LDO2.

In one or more embodiments, that risk may be countered by providing an overvoltage sensor (for instance, an overvoltage warning generator 18, of any type known to those skill in the art) which is sensitive to the voltage Vo1 at the output pin OUT_LDO1 and is configured, as a result of detecting an overvoltage event at LDO1, to issue an overvoltage signal OV1 towards the logic driver 12.

In one or more embodiments, the logic driver 12 is configured to act in such a way as to avoid tracking mode operation if occurrence of such an overvoltage event is detected by the sensor 18—even in those cases where the configurations of binary values applied to the two sets of output voltage selection pins SELx_LDO1 and SELx_LDO2 are identical.

This may occur by an activation signal $V_{CC_OP2}$ being issued towards a differential stage 20 (again an OpAmp, for instance) which is configured to act, for instance via a separation diode 20*a*, on the power switch 16 in such a way that the output voltage Vo2 is provided at the output pin OUT_LDO2 by the differential stage 20 independently of—that is without tracking—the differential stage 14.

As exemplified herein, this may occur as a function of a reference voltage $V_{REF}$ and a desired value for the output voltage $V_{O2}$ as received, for instance, via a potential divider (DIV) 22.

Such an "independent" mode of operation (a mode of operation where the output voltage $V_{O2}$ is provided via the differential stage 20, for instance) corresponds to the mode of operation adopted in the voltage regulator in the condition exemplified in FIG. 2A, namely a condition where the binary value of configurations applied to the two sets of output voltage selection pins SELx_LDO1 and SELx_LDO2 are different.

If such an "independent" mode of operation is adopted, overvoltage events affecting the output voltage Vo1 at the output pin OUT_LDO1 will not affect the (otherwise identical) output voltage Vo2 at output pin OUT_LDO2.

Figure 4:
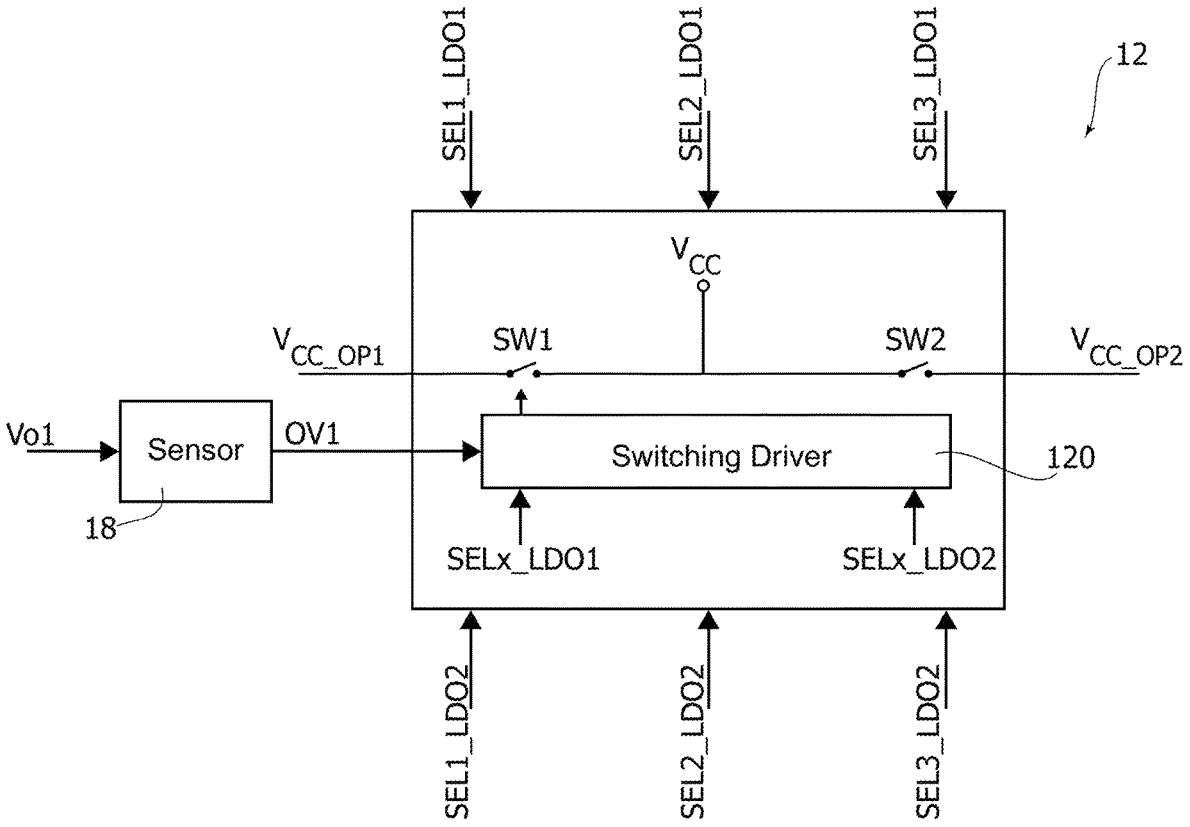

As exemplified in FIG. 4, issuance of either one of the signals $V_{CC_OP1}$ or $V_{CC_OP2}$, namely activation of either one of the differential stages 14 and 20, may correspond to actuation of respective switches (electronic switches such as MOSFET transistors, for instance) SW1 or SW2 controlled by a switching driver 120 in the logic driver 12.

In embodiments as exemplified herein, issuance of the signals $V_{CC_OP1}$ and $V_{CC_OP2}$ may be due to either one of the switches SW1 or SW2 being brought to a conductive, "on" state by the driver 120, thus coupling the respective stage 14 or 20 to a supply source Vcc which may correspond to Vbat in FIG. 1 (or to be derived therefrom).

In embodiments as exemplified herein, the switching driver 120 is sensitive to the (binary) output voltage selection values applied to the selection pins SELx_LDO1 and SELx_LDO2 and to the signal OV1 from the overvoltage sensor 18.

As discussed previously, this latter signal may be indicative of an overvoltage event detected at the first voltage regulator LDO1 (voltage Vo1 at the output pin OUT_LDO1).

Figure 5:
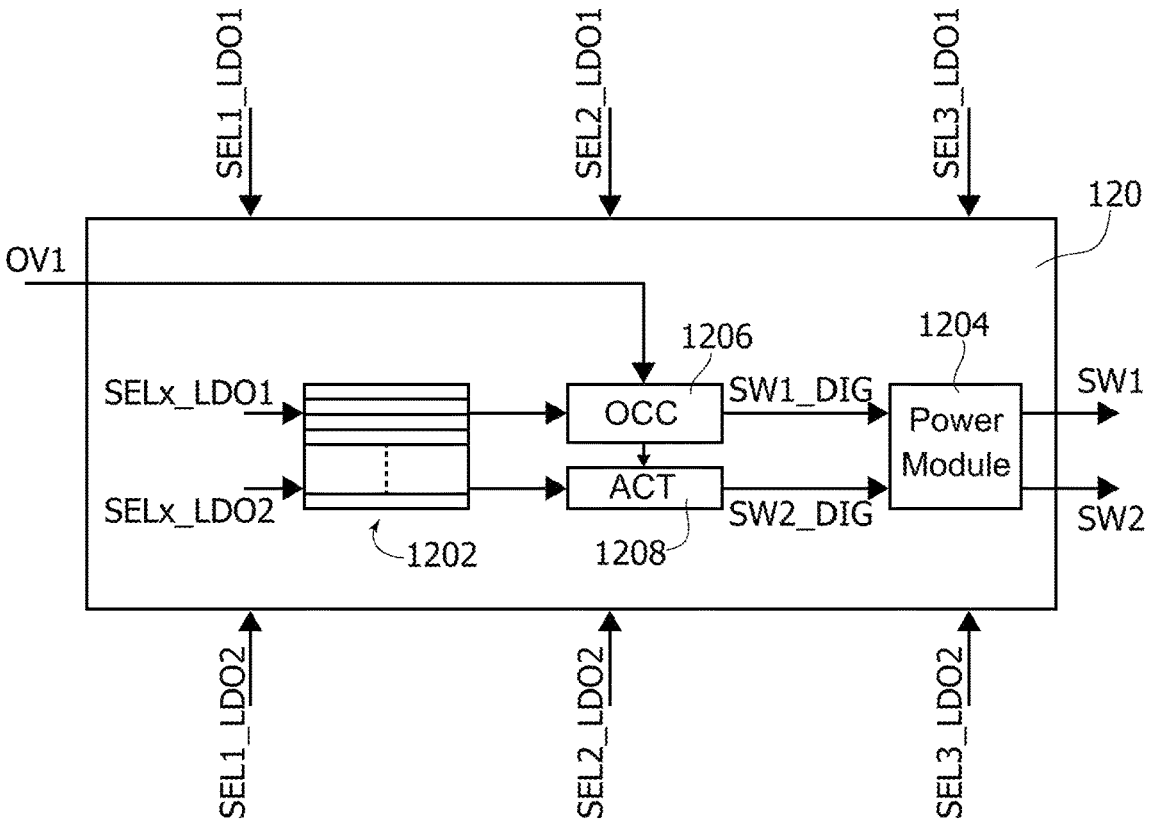

The diagram of FIG. 5 is further exemplary of possible features of a switching driver 120.

In one or more embodiments, the driver 120 may comprise a memory circuit block 1202 configured as a look-up table (LUT) wherein the binary values or combinations applied to the output voltage selection pins SELx_LDO1 and SELx_LDO2 are stored. The look-up table 1202 is coupled to a power module 1204 which controls the switches SW1, SW2 via activation signals SW1_DIG and SW_DIG2.

In one or more embodiments, the activation signal SW1_DIG (activation of the differential stage 14) for the switch SW1 may be issued via an overvoltage control circuit 1206 sensitive to the signal OV1 from the sensor 18.

In one or more embodiments, the activation signal SW2_DIG (activation of the differential stage 20) for the switch SW2 may be issued via an activation (ACT) block 1208 possibly coupled (also) to the overvoltage control circuit (OCC) 1206 in order to facilitate coordination of switching the switches SW1 and SW2 between conductive and non-conductive states in order to avoid undesired simultaneous activation of the stages 14 and 20.

Figure 6:
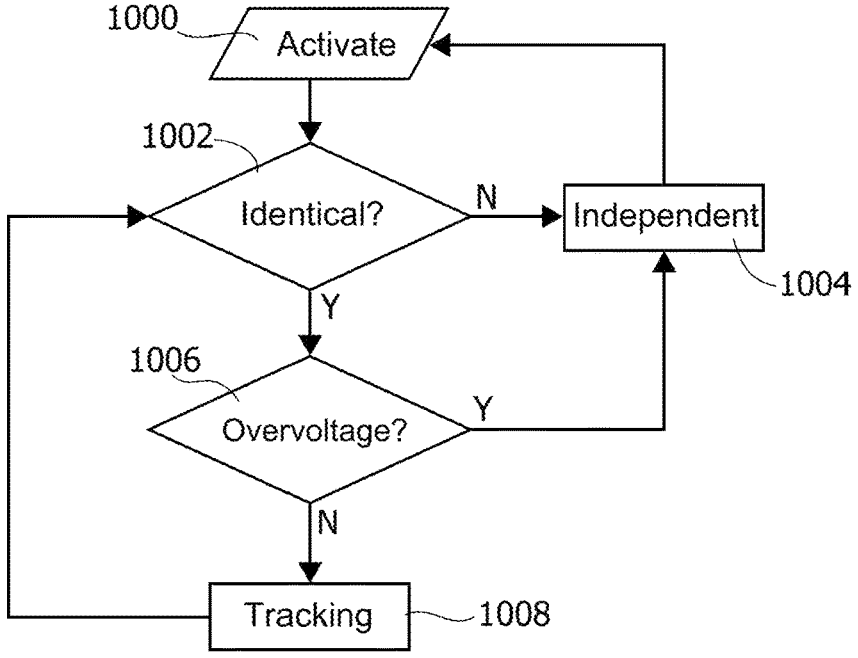
FIG. 6 is a flowchart exemplary of possible operation of embodiments disclosed herein.

Operation of an arrangement as exemplified herein may be along the lines of the flowchart of FIG. 6.

In that flowchart, the block 1000 is generally exemplary of the (dual) voltage regulator 10 being activated, while the block 1002 is exemplary of the digital inputs SELx_LDO1 and SELx_LDO2 (x=1, 2, 3) being checked for identity/non-identity (at the LUT 1020, for instance).

If the binary combinations supplied to SELx_LDO1 and SELx_LDO2 are found to be different (negative outcome N of block 1002), in an act as represented by block 1004, independent operation of the two voltage regulators LDO1, LDO2 (see FIG. 2A, with the differential stage 20 of FIG. 3 activated by $V_{CC_OP2}$, for instance) is enabled.

If the binary combinations supplied to SELx_LDO1 and SELx_LDO2 are found to be identical (positive outcome Y of block 1002) in an act as represented by block 1006, a check is made as to whether monitoring the output of the first voltage regulator LDO1 (Vo1 at OUT_LDO1) has revealed any overvoltage event, with a corresponding signal OV1 issued by the sensor 18, for instance.

A negative outcome of such action (negative outcome N of block 1006), indicative of no overvoltage events detected at the first voltage regulator LDO1 (Vo1 at OUT_LDO1), leads to tracking mode operation of the two voltage regulators LDO1, LDO2 (see FIG. 2B, with the differential stage 14 of FIG. 3 activated by $V_{CC_OP1}$, for instance) being enabled in an act as represented by block 1008.

This type of operation may be maintained until new sets of output voltage selection binary values SELx_LDO1 and SEL_x LDO2 are checked for identity/non-identity at block 1002.

As exemplified herein, a positive outcome of the act of checking for the occurrence of overvoltage events at LDO1 (positive outcome Y of block 1006, which is exemplary of an overvoltage event detected by the sensor 18 with a corresponding signal VO1 sent towards the switching driver 120) results in tracking mode operation being avoided, with the switch SW2 closed by the switching driver 120 so that the signal $V_{CC_OP2}$ is issued towards the differential stage 20 to produce "independent" operation of the two voltage regulators LDO1, LDO2 as exemplified in FIG. 2A.

In that way, as discussed previously, negative effects on the voltage regulator LDO2 can be avoided by via such a "de-tracking" action.

The flowchart of FIG. 6 is exemplary of possible embodiments where the occurrence of an overvoltage event as detected at 1006 leads to tracking mode operation being avoided—by avoiding entering—tracking mode operation (FIG. 2B).

It will be appreciated that in or more embodiments the occurrence of an overvoltage event as detected at 1006 may lead to tracking mode operation being avoided—by disabling—tracking mode operation already entered into.

This alternative approach may correspond to operation where (as an alternative to the flowchart shown in FIG. 6) the act exemplified by block 1008 takes place before (and not after) the act of checking exemplified by block 1006.

A circuit (for instance, 10) as exemplified herein may comprise:

at least one first voltage regulator (for instance, LDO1) having a first output voltage selection pin set (for instance, SEL1_LDO1, SEL2_LDO1, SEL3_LDO1), the at least one first voltage regulator configured to receive a first digital signal at the first output voltage selection pin set and activatable (suited to be activated) to produce a first output voltage (for instance, Vo1 at OUT_LDO1) which is a function of the first digital signal received at the first output voltage selection pin set, at least one second voltage regulator (for instance, LDO2) having a second output voltage selection pin set (for instance, SEL1_LDO2, SEL2_LDO2, SEL3_LDO2), the at least one second voltage regulator configured to receive a second digital signal at the second output voltage selection pin set and activatable (suited to be activated) to produce a second output voltage (for instance, Vo2 at OUT_LDO2) which is a function of the second digital signal received at the second output voltage selection pin set, wherein the at least one first voltage regulator and the at least one second voltage regulator are operable (see for instance block 1008 in FIGS. 6 and 14, $V_{CC_OP1}$ in FIG. 3) in a voltage tracking mode with the second output voltage of the at least one second voltage regulator tracking the first output voltage of the at least one first voltage regulator as a result of the first digital signal received at the first output voltage selection pin set and the second digital signal received at the second output voltage selection pin set having a same value, an overvoltage sensor (for instance, 18) configured to detect overvoltage events occurring at the at least one first voltage regulator, and control circuitry (for instance, 12) coupled to the overvoltage sensor, the control circuitry configured to avoid (see for instance, 1004) operation of the at least one first voltage regulator and the at least one second voltage regulator in the voltage tracking mode as a result of an overvoltage event (for instance, OV1) detected (for instance, 1006) at the at least one first voltage regulator.

In a circuit as exemplified herein, with operation in the voltage tracking mode avoided (for instance, 1004), the at least one second voltage regulator may be configured (see, for instance, 20, 20*a*, $V_{CC_OP2}$) to produce said second output voltage which is a function of the second digital signal received at the second output voltage selection pin set independently of the at least one first voltage regulator.

In a circuit as exemplified herein:

the control circuitry may be coupled to the first output voltage selection pin set in the at least one first voltage regulator and to the second output voltage selection pin set in the at least one second voltage regulator, the control circuitry may be configured to avoid operation of the at least one first voltage regulator and the at least one second voltage regulator in the voltage tracking mode:

a) as a result of the first digital signal received at the first output voltage selection pin set and the second digital signal received at the second output voltage selection pin set having different values (for instance, negative outcome N of 1002 in FIG. 6); or b) as a result of an overvoltage event detected (for instance, 1006) at the at least one first voltage regulator with the first digital signal received at the first output voltage selection pin set and the second digital signal received at the second output voltage selection pin set having a same value (for instance, positive outcome Y of 1002 in FIG. 6).

In a circuit as exemplified herein, the control circuitry may comprise:

a power supply node (for instance, Vcc), a first switch (for instance, SW1) configured to be switched to a conductive state to couple the at least one first voltage regulator (for instance LDO1, stage 14) to the power supply node, and a second switch (for instance, SW2) configured to be switched to a conductive state to couple the at least one second voltage regulator (for instance, LDO2, stage 20) to the power supply node.

A circuit as exemplified herein may comprise:

a memory circuit block (for instance, 1202) configured to store the first digital signal received at the first output voltage selection pin set of the at least one first voltage regulator and the second digital signal received at the second output voltage selection pin set of the at least one second voltage regulator, switch control circuitry (for instance, 1204, 1206, 1208) coupled to the memory circuit block and the overvoltage sensor (for instance, 18), the switch control circuitry configured to switch to a conductive state the first switch and the second switch as a function of the first digital signal, the second digital signal stored in the memory circuit block and an overvoltage signal being received from the overvoltage sensor circuitry as a result of an overvoltage event occurring at the at least one first voltage regulator.

A method of operating a circuit as exemplified herein may comprise:

checking (for instance, 1002) for identity the first digital signal at the first output voltage selection pin set and the second digital signal at the second output voltage selection pin set, as a result of a negative outcome of said checking for identity, enabling (for instance, 1004) independent operation of the at least one first voltage regulator and the at least one second voltage regulator, wherein the at least one first voltage regulator produces a first output voltage which is a function of the first digital signal received at the first output voltage selection pin set, and wherein the at least one second voltage regulator produces a second output voltage which is a function of the second digital signal received at the second output voltage selection pin set, as a result of a positive outcome of said checking for identity, checking (for instance, 1006) said overvoltage sensor for the occurrence of an overvoltage event at the at least one first voltage regulator, and a) if checking said overvoltage sensor indicates an overvoltage event at the at least one first voltage regulator (for instance, positive outcome at 1006), avoiding voltage tracking mode operation of the at least one first voltage regulator and the at least one second voltage regulator by enabling (for instance, again 1004) independent operation of the at least one first voltage regulator and the at least one second voltage regulator, wherein the at least one first voltage regulator and the at least one second voltage regulator produce a first output voltage and a second output voltage which are a function of the mutually identical first digital signal at the first output voltage selection pin set and the second digital signal at the second output voltage selection pin set, b) if checking said overvoltage sensor fails to indicate an overvoltage event at the at least one first voltage regulator (for instance, negative outcome at 1006), enabling (for instance, 1008) voltage tracking mode operation of the at least one first voltage regulator and the at least one second voltage regulator, with the second output voltage of the at least one second voltage regulator tracking the first output voltage of the at least one first voltage regulator.

The claims are an integral part of the technical disclosure of the embodiments provided herein. Without prejudice to the underlying principles the details and embodiments may vary, even significantly, without departing from the scope of protection.

The invention claimed is:

1. A circuit, comprising:

a first voltage regulator having a first output voltage selection pin set, the first voltage regulator configured to receive a first digital signal at the first output voltage selection pin set and produce a first output voltage which is a function of the first digital signal received at the first output voltage selection pin set;

a second voltage regulator having a second output voltage selection pin set, the second voltage regulator configured to receive a second digital signal at the second output voltage selection pin set and produce a second output voltage which is a function of the second digital signal received at the second output voltage selection pin set;

wherein the first voltage regulator and the second voltage regulator are operable in a voltage tracking mode with the second output voltage of the second voltage regulator tracking the first output voltage of the first voltage regulator as a result of the first digital signal received at the first output voltage selection pin set and the second digital signal received at the second output voltage selection pin set having same values;

an overvoltage sensor configured to detect an overvoltage event occurring at an output of the first voltage regulator; and a control circuitry coupled to the overvoltage sensor, the control circuitry configured to avoid operation of the first voltage regulator and the second voltage regulator in the voltage tracking mode as a result of said overvoltage event detected at the output of the first voltage regulator.

2. The circuit of claim 1, wherein, with operation in the voltage tracking mode avoided, the second voltage regulator is configured to produce said second output voltage, which is a function of the second digital signal received at the second output voltage selection pin set, independently of the first voltage regulator.

3. The circuit of claim 2, wherein:

the control circuitry is coupled to the first output voltage selection pin set in the first voltage regulator and to the second output voltage selection pin set in the second voltage regulator; and the control circuitry is configured to avoid operation of the first voltage regulator and the second voltage regulator in the voltage tracking mode:

a) as a result of the first digital signal received at the first output voltage selection pin set and the second digital signal received at the second output voltage selection pin set having different values; or b) as a result of said overvoltage event detected at the output of the first voltage regulator and the first digital signal received at the first output voltage selection pin set and the second digital signal received at the second output voltage selection pin set having a same value.

4. The circuit of claim 1, wherein:

the control circuitry is coupled to the first output voltage selection pin set in the first voltage regulator and to the second output voltage selection pin set in the second voltage regulator; and the control circuitry is configured to avoid operation of the first voltage regulator and second voltage regulator in the voltage tracking mode:

a) as a result of the first digital signal received at the first output voltage selection pin set and the second digital signal received at the second output voltage selection pin set having different values; or b) as a result of said overvoltage event detected at the output of the first voltage regulator and the first digital signal received at the first output voltage selection pin set and the second digital signal received at the second output voltage selection pin set having a same value.

5. The circuit of claim 1, wherein the control circuitry comprises:

a power supply node;

a first switch configured to be selectively switched to a conductive state to couple the first voltage regulator to the power supply node; and a second switch configured to be selectively switched to a conductive state to couple the second voltage regulator to the power supply node.

6. The circuit of claim 5, further comprising:

a memory circuit configured to store the first digital signal received at the first output voltage selection pin set of the first voltage regulator and to store the second digital signal received at the second output voltage selection pin set of the second voltage regulator; and a switch control circuitry coupled to the memory circuit and the overvoltage sensor, the switch control circuitry configured to switch the first or second switch to the conductive state as a function of the first digital signal, the second digital signal stored in the memory circuit, and an overvoltage signal received from the overvoltage sensor as a result of said overvoltage event detected at the output of the first voltage regulator.

7. A method of operating a circuit, comprising: a first voltage regulator having a first output voltage selection pin set, the first voltage regulator configured to receive a first digital signal at the first output voltage selection pin set and produce a first output voltage which is a function of the first digital signal received at the first output voltage selection pin set; a second voltage regulator having a second output voltage selection pin set, the second voltage regulator configured to receive a second digital signal at the second output voltage selection pin set and produce a second output voltage which is a function of the second digital signal received at the second output voltage selection pin set; wherein the first voltage regulator and the second voltage regulator are operable in a voltage tracking mode with the second output voltage of the second voltage regulator tracking the first output voltage of the first voltage regulator as a result of the first digital signal received at the first output voltage selection pin set and the second digital signal received at the second output voltage selection pin set having same values; an overvoltage sensor configured to detect overvoltage events occurring at an output of the first voltage regulator; and control circuitry coupled to the overvoltage sensor;

wherein the method of operating the circuit comprises:

identifying the first digital signal at the first output voltage selection pin set and the second digital signal at the second output voltage selection pin set;

as a result of a negative outcome of said identification, enabling independent operation of the first voltage regulator and the second voltage regulator, wherein the first voltage regulator produces a first output voltage which is a function of the first digital signal received at the first output voltage selection pin set and the second voltage regulator produces a second output voltage which is a function of the second digital signal received at the second output voltage selection pin set;

as a result of a positive outcome of said identification, checking said overvoltage sensor for occurrence of an overvoltage event at the output of the first voltage regulator, and a) if checking said overvoltage sensor indicates said overvoltage event at the output of the first voltage regulator, avoiding voltage tracking mode operation of the first voltage regulator and the second voltage regulator by enabling independent operation of the first voltage regulator and the second voltage regulator, wherein the first voltage regulator and the second voltage regulator produce a first output voltage and a second output voltage which are a function of a mutually identical first digital signal at the first output voltage selection pin set and second digital signal at the second output voltage selection pin set; or b) if checking said overvoltage sensor fails to indicate said overvoltage event at the output of the first voltage regulator, enabling voltage tracking mode operation of the first voltage regulator and the second voltage regulator, with the second output voltage of the second voltage regulator tracking the first output voltage of the first voltage regulator.

8. A circuit, comprising:

a first voltage regulator having a first output voltage selection input, the first voltage regulator configured to receive a first digital signal at the first output voltage selection input which specifies a first output voltage to be produced;

a second voltage regulator having a second output voltage selection input, the second voltage regulator configured to receive a second digital signal at the second output voltage selection input which specifies a second output voltage to be produced;

an overvoltage sensor configured to detect an overvoltage of the first voltage regulator;

a control circuitry coupled to the overvoltage sensor, the control circuitry configured to control operation of the first voltage regulator and the second voltage regulator in a voltage tracking mode with the second output voltage tracking the first output voltage in response to the first digital signal received and the second digital signal having same values; and wherein the control circuitry is further configured to selectively prevent operation of the first voltage regulator and the second voltage regulator in the voltage tracking mode when the first digital signal and the second digital signal have a same value but said overvoltage of the first voltage regulator is detected.

9. The circuit of claim 8, wherein, when operation in the voltage tracking mode is prevented by the control circuitry, the second voltage regulator is configured to produce said second output voltage, which is a function of the second digital signal received independently of the first voltage regulator.

10. The circuit of claim 8, wherein the control circuitry comprises:

a power supply node;

a first switch being selectively switchable to a conductive state to couple the first voltage regulator to the power supply node; and a second switch being selectively switchable to a conductive state to couple the second voltage regulator to the power supply node.

11. The circuit of claim 10, further comprising:

a memory circuit configured to store the first digital signal and the second digital signal, and a switch control circuitry coupled to the memory circuit and the overvoltage sensor, the switch control circuitry configured to switch the first or second switch to its conductive state as a function of the first digital signal stored in the memory circuit, the second digital signal stored in the memory circuit, and an overvoltage signal received from the overvoltage sensor as a result of said overvoltage of the first voltage regulator being detected.

12. A circuit, comprising:

a first voltage regulator configured to produce a first output voltage;

a second voltage regulator configured to produce a second output voltage;

wherein the first voltage regulator and the second voltage regulator are operable in a voltage tracking mode with the second output voltage tracking the first output voltage, in response to first and second digital signals associated with the first and second voltage regulators;

an overvoltage sensor configured to detect overvoltage events occurring at an output of the first voltage regulator; and a control circuitry coupled to the overvoltage sensor, the control circuitry configured to selectively prevent operation of the first voltage regulator and the second voltage regulator in the voltage tracking mode based upon the first and second digital signals.

13. The circuit of claim 12, wherein the control circuitry prevents operation of the first and second voltage regulators in the voltage tracking mode if the first digital signal and the second digital signal have different values.

14. The circuit of claim 12, wherein the control circuitry prevents operation of the first and second voltage regulators in the voltage tracking mode if the first digital signal and the second digital signal have a same value but an overvoltage event is detected at the output of first voltage regulator.

15. The circuit of claim 12, wherein, when operation in the voltage tracking mode is prevented by the control circuitry, the second voltage regulator is configured to produce said second output voltage independently of the first voltage regulator.

16. The circuit of claim 12, wherein the control circuitry comprises:

a power supply node;

a first switch being selectively switchable to a conductive state to couple the first voltage regulator to the power supply node; and a second switch being selectively switchable to a conductive state to couple the second voltage regulator to the power supply node.

17. The circuit of claim 10, further comprising:

a switch control circuitry configured to switch the first or second switch to its conductive state as a function of the first digital signal, the second digital signal, and an overvoltage signal received from the overvoltage sensor as a result of an overvoltage event being detected at the output of the first voltage regulator.

* * * * *